US008931633B2

(12) United States Patent
Martin, III

(10) Patent No.: US 8,931,633 B2
(45) Date of Patent: Jan. 13, 2015

(54) AMMUNITION CARRIER AND LOADER

(71) Applicant: Haskell H. Martin, III, Albany, GA (US)

(72) Inventor: Haskell H. Martin, III, Albany, GA (US)

( * ) Notice: Subject to any disclaimer, the term of this patent is extended or adjusted under 35 U.S.C. 154(b) by 0 days.

(21) Appl. No.: 14/085,355

(22) Filed: Nov. 20, 2013

(65) Prior Publication Data

US 2014/0202884 A1 Jul. 24, 2014

Related U.S. Application Data

(60) Provisional application No. 61/728,408, filed on Nov. 20, 2012.

(51) Int. Cl.
*F42B 39/00* (2006.01)
*F42B 39/26* (2006.01)
*F41A 9/85* (2006.01)

(52) U.S. Cl.
CPC . *F42B 39/26* (2013.01); *F41A 9/85* (2013.01); *Y10S 224/931* (2013.01)
USPC ..... 206/3; 206/480; 224/931

(58) Field of Classification Search
USPC ..... 206/3, 477, 480, 483, 485, 443; 224/931
See application file for complete search history.

(56) References Cited

U.S. PATENT DOCUMENTS

| | | | | |
|---|---|---|---|---|
| 2,990,945 | A * | 7/1961 | Smith | 206/3 |
| 3,213,559 | A * | 10/1965 | Matich | 42/89 |
| 3,923,152 | A * | 12/1975 | Minneman | 206/3 |
| 4,657,132 | A * | 4/1987 | Abdo | 206/3 |
| 2007/0044363 | A1 * | 3/2007 | McClellan | 42/87 |
| 2014/0124387 | A1 * | 5/2014 | Iannello et al. | 206/3 |

* cited by examiner

*Primary Examiner* — David Fidei
(74) *Attorney, Agent, or Firm* — Brian D. Bellamy

(57) ABSTRACT

A carrier and loader for cartridges with a base component hinged to a cover component. A clip portion with rib formations provides resilient clips for frictional engagement and holding the cartridges, which are pried from the channel of the clips for loading. With the carrier in an open position, cartridges are inserted one or two at a time directly into the swing-out cylinder of a revolver without handling the cartridges.

5 Claims, 3 Drawing Sheets

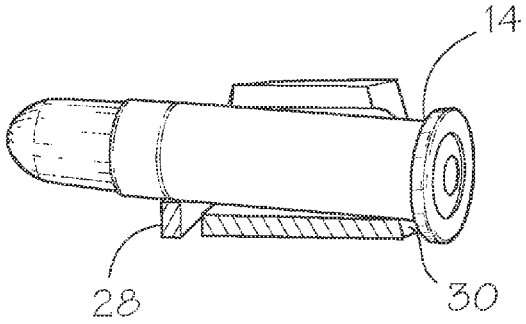
Fig. 3A
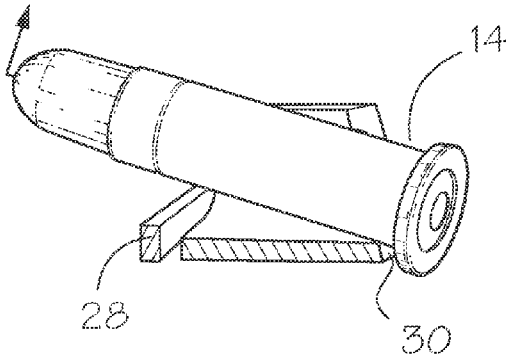
Fig. 3B
Fig. 4
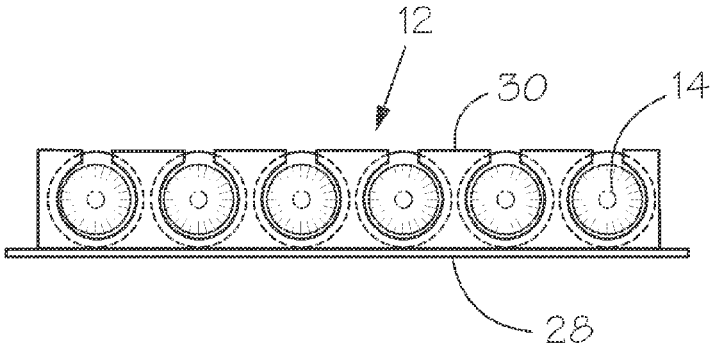

AMMUNITION CARRIER AND LOADER

PRIORITY CLAIM

The present application claims benefit of priority of U.S. Provisional Patent Application No. 61/728,408 with a priority filing date of Nov. 20, 2012.

BACKGROUND OF THE INVENTION

1. Field of the Invention

The present invention relates to ammunition storage for revolvers and, in particular, to a compact ammunition carrier for pockets and for loading revolvers with a swing out cylinder.

2. Discussion of the Prior Art

Cartridges are currently loaded into a swing out cylinder of a revolver either singularly by hand, or by using a device such as a plastic strip or a round loader matching the cylinder. Such devices are sold in sporting goods stores, gun stores and various gun and ammunition catalogs. The most popular of these devices are the brand SPEED STRIPS and the device referred to as a Speedloader. SPEED STRIPS for revolvers are a slim alternative to looses rounds in the pocket, a dump pouch or a speed loader. A typical strip holds six cartridges in a re-usable NEOPRENE or urethane plastic strip. The cartridges are held in the strip by insertion into a circular recess. The strip operates by placing the cartridges one or two at a time into their respective chambers of the revolver cylinder and dislodging the rounds off the strip into the chamber. The strip fits compactly in most police-style cartridge boxes or trouser pockets. The strip does not provide a cover to secure the cartridges.

A Speedloader holds a number of cartridges according to the design of a revolver's swing out cylinder. The Speedloader instantly drops cartridges with a twist to release metal points that hold the cartridges in the loader. The Speedloader allows for loading the entire cylinder of your revolver. Strong metal points hold cartridges securely in a polymer body until released. A knurled aluminum knob provides a grip and a means to grab the Speedloader out of a pouch. The Speedloader is somewhat bulky to carry in a pocket and does not conceal the cartridges. Therefore, a supplementary pouch or strip is often desired.

In viewing the prior art, a need continues to exist for an improved pocket ammunition carrier and loader for use by people who use revolvers. These include persons with concealed carry permits who carry for personal protection, those who use revolvers in hunting, The need is for a compact pocket ammunition carrier that securely holds ammunition for a revolver while also concealing the ammunition. The preferred carrier needs a small footprint for concealed carry and should be readily carried in the pants pocket. While there are pouches that meet these needs, they fail to make loading ammunition easier than loading single cartridges by hand. Therefore, the carrier also needs to be easy to handle and easy to open for loading ammunition. The carrier should minimize the handling of ammunition cartridges. Thus, it would be desirable to load cartridges directly from the carrier.

BRIEF SUMMARY OF THE INVENTION

A compact pocket ammunition carrier and loader is provided that is designed for revolvers with swing out cylinders. The pocket ammunition carrier and loader is compact and convenient to carry and use for loading a revolver with cartridges that are to be loaded singly. The design of the ammunition carrier and loader allows each cartridge in the carrier to be fed and loaded into the swing out cylinder directly from the carrier to the cylinder. The device provides a clean and convenient way to carry or store extra ammunition cartridges, and can be used in a variety of contexts. For instance, the device can be used concealed on the person or for storing ammunition cartridges at a bedside table, console, or backpack, and providing extra ammunition in the case of a need.

The ammunition carrier and loader carries a multiplicity of extra cartridges with less bulk that many conventional carry storage devices. The device holds the cartridges in a plurality of approximately u-shaped clips formed of upstanding ribs forming receptacle channels for the individual cartridges. The device is formed of plastic and the clips are concealed by a pivotally hinged base component and a cover component that also assist in securely holding the cartridges. The cartridges are removed from the clips by pulling one or two cartridges from the each respective channel by pressing the cartridges into the chambers of the cylinder.

BRIEF DESCRIPTION OF THE DRAWINGS

FIG. 3A is a perspective sectional view of a clip as used with an embodiment of the invention showing ammunition held for carrying in the clip.

FIG. 3B is a perspective sectional view of the clip in FIG. 3A showing an ammunition cartridge being dislodged from the clip for loading into a chamber of a revolver cylinder.

FIG. 4 is a top plan view of a clip portion of the ammunition carrier and loader according to an embodiment of the invention.

DETAILED DESCRIPTION OF THE INVENTION

Figure 1:
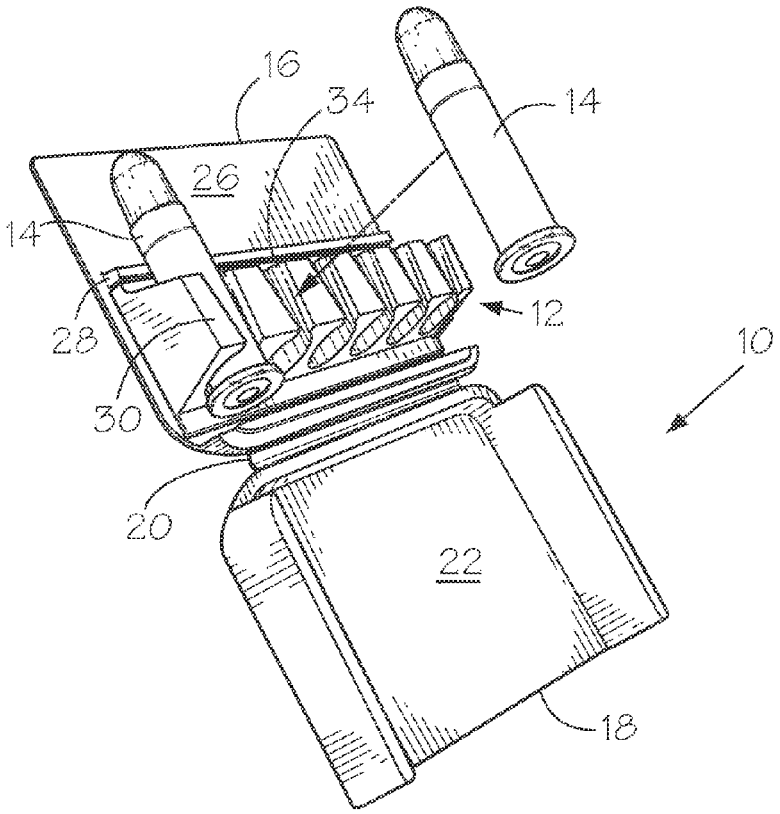
FIG. 1 is a perspective view of the device in accordance with the invention showing a means for carrying ammunition cartridges.

Referring to the drawings, FIG. 1 shows an ammunition carrier and loader device 10 in accordance with an exemplary embodiment of the invention. The carrier device includes a plurality of clips for holding a multiplicity of elongate ammunition cartridges 14 or bullets like used in a swing-out cylinder style revolver. The embodiment shown includes a total of six ammunition receiving clips, which would be ideal for users having a six chamber revolver. Other embodiments may be designed and constructed with more or less clips to accommodate the user's choice of handgun. Ammunition cartridges are inserted into the number of clips as show in FIG. 1.

Figure 2:
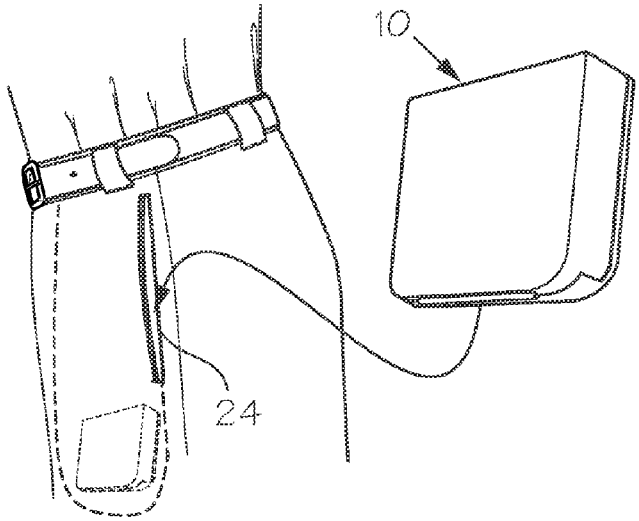
FIG. 2 is a perspective view of the ammunition carrier and loader according to the invention showing a convenient means for carrying the device in a pocket.

The carrier includes a base component 16, a closure component 18 and a connecting hinge component 20 for holding the integrated ammunition cartridge receiving clips. Both the base component 16 and the closure component 18 include an exterior surface that protects the user's ammunition while the device is closed. The connecting hinge component 20 is arranged along one side of said base and closure components attaching the base and closure components in hinge-like manner for relative movement of the two components along the axis provided by the hinge component 20 from an open position to a closed position. In the open position the closure component 18 is pivotally displaced from the base component 16 along the hinge attachment provided by the hinge component 20. The carrier is closed by rotating the closure component 18 toward the base component 16 to the closed position overlying the base component. Closing the carrier by placing the closure component 18 in a closed position overlying the base component 16 retains cartridges 14 therein and protects them. The closure component 18 ensures that the ammunition cartridge cannot be dislodged or accidentally dropped from the carrier and includes an interior cover surface 22 that retains the ammunition cartridges 14 within the clips. When closed as shown in FIG. 2, the carrier and loader device 2 can be inserted into a pocket 24 for convenience and carried without worry that cartridges 14 will be dislodged inadvertently. Meanwhile, the carrier and loader design provides a very compact case that fits very well within a user's pocket 24 or purse as depicted in FIG. 2.

The base component 16 includes an interior support surface 26 for attachment or attached integration of an upstanding clip portion 12 comprising clips and a lateral ridge formation 28 shown in FIG. 1. The upstanding clip portion 12 of the carrier and loader device 10 supports and holds several pieces of ammunition. The clip portion 12 includes a multiplicity of upstanding internal rib formations 30 that are attached to the interior support surface 26. The rib formations 30 divide the clip portion 12 into a plurality of ammunition cartridge receiving clips. The rib formations 30 are comprised of a resilient material such as plastic or rubber that provides a small amount of flexing when an ammunition cartridge is inserted into one of the clips. The clip portion 12 of the device is formed by the rib formations 30, which have enough elasticity for loading and releasing cartridges 14 into the cylinder 36 of a revolver, but provide enough resistance for frictional engagement with the cartridges. Thereby, the resilience and elasticity of the rib formations 30 of the clips provides for friction between the interior surfaces of the rib formations 30 to grip the ammunition cartridges 14 and securely hold ammunition within the carrier and loader 10 via the clips.

The internal rib formations 30 are arranged on the interior support surface 26 of the base component 16 in parallel spaced relationship. The rib formations 30 have an upstanding vertical structure shown in FIGS. 3A and 3B having opposing ends and having at least one inner face. Moreover, the interior ribs have having opposing faces that define a channel between the rib formations 30 as seen in FIGS. 1 and 4. The parallel rib formations 30 define a plurality of approximately U-shaped parallel extending ammunition cartridge receiving clips that are connected together in the clip portion 12. The inner face of each rib formation 30 opposes another and is tapered to grip the cartridge 14. Each receiving clip 12 for ammunition cartridge includes a first and a second rib formation 30 defining each U-shaped clip and defining the channel within the structure of each clip.

Cartridges 14 clip into the channel of each clip 12. As described before, the inner face of each rib formation 30 is tapered, which provides for one end of the channel more tightly gripping the cartridge 14. The opposing tapered inner faces of the rib formations 30 define a resilient first opening 32 on a first end of the channel. The first opening 32 has a defined diameter that is generally less than the rim of an ammunition cartridge 14, but at least as wide as the body of the ammunition cartridge. As discussed above, the defined width of the channel should provide frictional engagement with the body portion of the ammunition cartridge. The opposing tapered inner faces of the rib formations 30 also define a resilient second opening 34 on a second end of the channel, wherein the opposite first and second ends of the channel define the length of each channel in accordance with a portion of the length of an ammunition cartridge 14. The length of each channel is less than the respective cartridge so that the tip of the cartridge 14 can be inserted into the chamber of the revolver cylinder 36 as in FIG. 5. The second opening 34 of the channel has a defined diameter that is at least as wide as the body of the cartridge when the clip is loaded with a cartridge. The channel diameter may be less than that of the cartridge if a sufficiently resilient plastic material is used to compose the rib formations 30, whereby the rib formations 30 will be sufficiently resilient when bent for insertion of a cartridge 14. Some separation of the inner faces for insertion of a cartridge may be desirable to improve frictional engagement of the opposing inner faces with the body of the respective cartridge when the cartridge is retained in the clip. The clip will release the ammunition cartridge by exerting force and prying the ammunition cartridge from the channel of the clip and from the first opening 32. At least the first opening 32 should engage the cartridge with frictional resistance to removal of the cartridge from the clip.

The closure component 18 discussed above includes an interior cover surface 22. When the closure component 18 is in the closed position as in FIG. 2, the interior cover surface 22 overlies the internal rib formations 30 of the clips and may even abut the respective top surface of the internal rib formations. This relationship between the interior cover surface 22 of the closure component 18 and the clips seals the cartridges 14 into the clips until the closure component 18 is opened and displaced from the base component 16.

The lateral ridge formation 28 in FIG. 1 is spaced from the second end of the channel of the ammunition cartridge receiving clips. The ridge 28 extends laterally across the interior support surface 26 of the base component 16 and can be integrated as a part of the interior support surface. The space between the lateral ridge 28 and the second end of the channel is defined so that the ridge will support a portion an ammunition cartridge that extends from the second end of the channel. This supportive ridge 28 helps to secure the cartridges 14 into the channels and hold the cartridges in alignment with the channels. The ridge 28 also supports the cartridges 14 in a manner that make insertion of the tip of the cartridge into the chamber of a revolver cylinder 36 more efficient because the bullets are already aligned and arranged sufficient distance from the interior support surface 26 of the base component 16 so as to minimize interference.

The closure component 18 may partially or completely enclose cartridges 14 within the carrier and loader device 10 when placed in closed position of FIG. 2. Therefore peripheral sidewall elements are arranged on the closure component 18. The sidewall elements extend from opposing side edges of the closure component 18. The sidewall elements may abut against the edges of the interior support surface 26 of the base components when closed. By arranging the sidewall elements on the closure component 18, the sidewalls cannot interfere with loading a cartridge when the device is in open position shown in FIG. 1. The cartridges 14 will be exposed in the clip portion 12 supported on the base component 16 for loading into a revolver cylinder 36. An additional end wall element may be arranged on the closure component 18 on the edge opposite and distal from the hinge. The end wall element in combination with the sidewall elements will completely enclose the cartridges 14 with the device in the closed position. An additional peripheral flange portion is arranged on the bottom edge of the base component 16. The peripheral flange portion forms a bottom wall of the carrier when in the closed position, whereby the bottom and sides are enclosed, and optionally all four sides are enclosed.

In one embodiment, the base component 16, closure component 18, connecting hinge component 20, and clip component are integrally thermoformed from sheeting of synthetic resinous material. The carrier device may include a means for holding the cover component in closed position relative to the base component 16. In the embodiment shown, the respective outer face of the respective ends of the internal rib formations 30 are situated in face-to-face relation to the respective inner face of the sidewall elements. In this arrangement, the respective sidewall elements are situated in frictional engagement with the outside surfaces of internal rib formations 30. A resilient tab received within an indentation or other means may be added to secure the engagement between the sidewall elements and base component 16. This exemplary embodiment displays the advantage that the entire carrier and loading device may be formed, molded, or stamped from a single sheet or single mold.

Figure 5A:
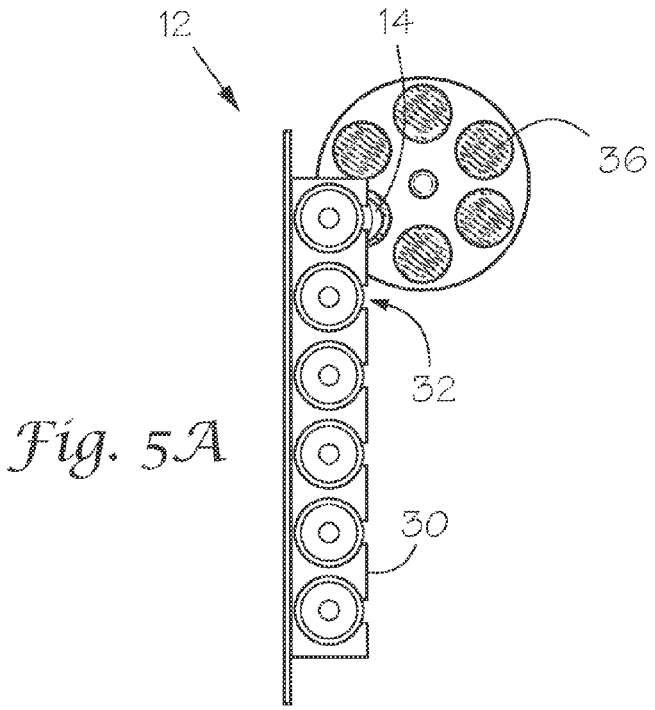
FIG. 5A is a top plan view of a revolver swing out cylinder receiving ammunition cartridges from the clip portion of the ammunition carrier and loader into chambers of the cylinder in accordance with a first method of using the invention.
Figure 5B:
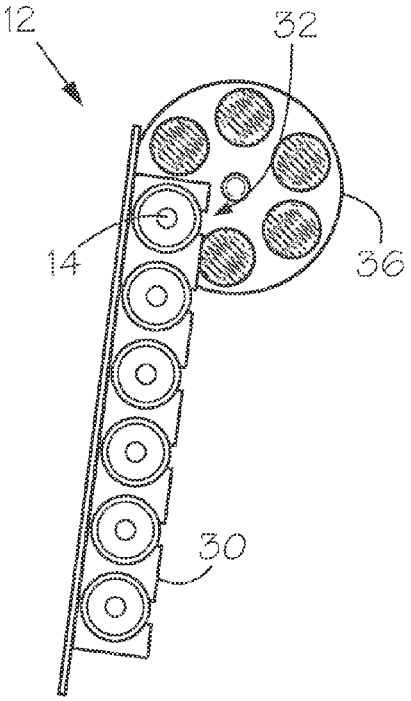
FIG. 5B is a top plan view of a revolver swing out cylinder as in FIG. 5A receiving ammunition cartridges in accordance with a second method of using the invention.
Figure 5C:
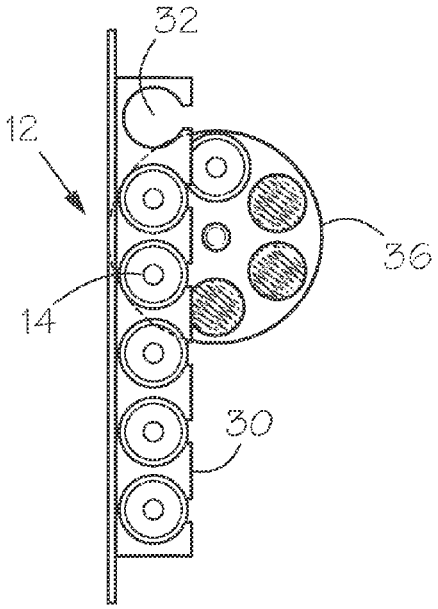
FIG. 5C is a top plan view of a revolver swing out cylinder as in FIG. 5A receiving ammunition cartridges in accordance with a third method of using the invention.

In general use of the carrier and loader device 10, a cartridge is loaded into a revolver with the cover component in the open position as shown in FIG. 1. Referring to FIG. 5A, 5B and 5C, one or two cartridges 14 are arranged over chambers of the swing-out cylinder 36 of the revolver. These nose of these cartridges 14, which extends beyond from second end of the clip 12 are placed into the respective chamber. The lateral ridge formation 28 provides enough distance between the cartridge in the loader and the edge of the cylinder 36 of the revolver for the bullet nose to clear the edge of the cylinder. The clips in the carrier and loader device 10 are spaced in accordance with the design of the related revolver.

Accordingly, the size of the cylinder 36 in the revolver determines the preferred distance between the cartridges 14 in the loader. An example is shown in FIGS. 4 and 5. The spacing of the clips 12 to hold bullets about the same spacing as the chambers of the cylinder will permit a user to insert two bullets at a time into the revolver when the device is used in accordance with FIG. 5C. Inserting two bullets simultaneously may requires slightly more skill and the device can be used very efficiently inserting one bullet at a time in accordance with the methods depicted in FIG. 5A and FIG. 5B. This actual manner of use and the angle that the user inserts a bullet using the carrier is a matter of personal preference.

What has been described above includes examples of the present invention. It is, of course, not possible to describe every conceivable combination of components or methodologies for purposes of describing the present invention, but one of ordinary skill in the art may recognize that many further combinations and permutations of the present invention are possible. Accordingly, the present invention is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The invention claimed is:

1. A carrier for holding a multiplicity of elongated ammunition cartridge comprising:

a base component having an exterior surface and an interior support surface;

a closure component having an interior cover surface;

a connecting hinge component along one side of said base and closure components;

said base component having an upstanding clip portion and a lateral ridge formation attached to the interior support surface;

said clip portion having a multiplicity of upstanding internal rib formations dividing said clip portion into a plurality of resilient cartridge receiving clips;

said internal rib formations being in parallel spaced relationship to define a plurality of U-shaped parallel extending cartridge receiving clips which are connected together in the clip portion;

each cartridge receiving clip having first and second rib formations defining a channel, each rib formation includes an inner face opposing the other, each inner face being tapered defining a resilient first opening on a first end of the channel with defined diameter less than a rim of said cartridge and at least as wide as the body of said cartridge and said channel providing frictional engagement with the body of said cartridge and a resilient second opening on a second end of the channel with defined diameter at least as wide as the cylinder of said cartridge whereby the clips retain said cartridge and releases said cartridge by exerting force prying the cartridge from the first opening;

said closure component being pivotally connected by said hinge component between a closed position overlying said base component and an open position displaced therefrom;

with said upstanding internal rib formations seating against said interior cover surface of said closure component in said close position of said carrier with said interior cover surface of the closure component overlying said internal rib formations;

said lateral ridge formation is spaced from said second end of said channel of said cartridge receiving clips and extends laterally across the interior support surface of said base component; and said closure component having respective peripheral sidewall elements extending from opposing side edges.

2. A carrier for holding a multiplicity of elongated ammunition cartridge as in claim 1 in which said base, closure and connecting hinge components are integrally thermoformed from sheeting of synthetic resinous material.

3. A carrier for holding a multiplicity of elongated ammunition cartridge as in claim 1 in which said base component includes a peripheral flange portion on the bottom.

4. A carrier for holding a multiplicity of elongated ammunition cartridge as in claim 1 in which said carrier includes a closed position in which respective outer face of respective end internal rib formations are situated in face-to-face relation to a respective inner face of the sidewall elements, and with said respective sidewall elements thereof being in frictional engagement with the internal rib formations.

5. A carrier for holding a multiplicity of elongated ammunition cartridge as in claim 2 in which said clip portion of the base component is integrally thermoformed from sheeting of synthetic resinous material.

* * * * *